United States Patent [19]

Lindsay

[11] 4,060,276

[45] Nov. 29, 1977

[54] COOLING SEAT

[76] Inventor: Robert A. Lindsay, 2105 Harrell Road, Orlando, Fla. 32807

[21] Appl. No.: 744,030

[22] Filed: Nov. 22, 1976

[51] Int. Cl.[2] ..... A47C 7/74

[52] U.S. Cl. ..... 297/180; 297/382

[58] Field of Search ..... 297/180, 454, 455, 382; 5/365, 347, 355, 367; 62/529, 530, 438, 457, 458

[56] References Cited

U.S. PATENT DOCUMENTS

| | | | |
|---|---|---|---|
| 1,593,066 | 7/1926 | Gaston | 297/180 |
| 2,722,266 | 11/1955 | Kersten | 297/180 |
| 2,734,556 | 2/1956 | Hebrank | 297/382 X |
| 2,976,700 | 3/1961 | Jackson | 297/180 X |
| 3,401,535 | 9/1968 | Palmer | 62/457 |
| 3,678,703 | 7/1972 | Cornish et al. | 62/457 X |
| 3,802,220 | 4/1974 | Pompo | 62/430 X |
| 3,858,410 | 1/1975 | Drake | 62/430 X |
| 3,922,879 | 12/1975 | Arnold | 62/430 X |

*Primary Examiner*—Roy D. Frazier
*Assistant Examiner*—Darrell Marquette
*Attorney, Agent, or Firm*—Duckworth, Hobby & Allen

[57] ABSTRACT

This invention relates to a portable seat cushion which unfolds to form a seat section and a back section. Both the seat and back sections include therein a frozen coolant package covered by a thermally transparent pad or cushion. The coolant package contains a liquid which may be frozen in the freezer section of an ordinary refrigerator and then placed within a recess in the seat and back sections of the seat cushion for absorbing heat, and thereby cooling the occupant of the seat cushion.

9 Claims, 3 Drawing Figures

COOLING SEAT

BACKGROUND OF THE INVENTION

I. Field of the Invention

This invention relates to portable, self-cooling seats of the type used in automobiles or for sporting events.

II. Description of the Prior Art

Truck drivers, bus drivers, cab drivers and other persons who earn a living by driving a motor vehicle for a substantial length of time are well aware of the need of a self-cooling seat which can be movably transferred between non-airconditioned vehicles. The use of such self-cooling seats provides increased comfort during the long hot days when the driver must operate the unairconditioned vehicle.

The prior art discloses several different design approaches to the problem of providing an inexpensive, effective and long lasting cooling seat.

A first group of inventors utilize external power sources for providing cooling to the operator or seat occupant. Kronhaus in U.S. Pat. No. 2,544,506 utilizes an external fan for ventilating a porous seat cushion, Kersten in U.S. Pat. No. 2,722,266 discloses a seat cushion containing coils cooled by a Freon refrigeration system driven by the engine of the motorized vehicle. Richard U.S. Pat. No. 3,136,577 discloses a seat cushion utilizing thermal-electric elements operating in accordance with the Peltier effect for cooling the seat.

A second group of inventors utilize ram air obtained from outside the motor vehicle to circulate through the ventilated seat cushion. Fry in U.S. Pat. No. 2,931,286 and Guest in U.S. Pat. No. 2,791,956 disclose inventions of this type.

A third design approach employs a liquid-saturated wick element formed as a part of the seat cushion and allowing the liquid to evaporate for absorbing the heat adjacent thereto. Gaston in U.S. Pat. No. 1,593,066 discloses such an invention. Jackson in U.S. Pat. No. 2,976,700 discloses a similar invention with the further inclusion of an ice storage section at the top of the back of the seat cushion. As the ice melts the cold water travels along a wick element which cools the air adjacent thereto by convection as well as evaporation.

SUMMARY OF THE INVENTION

This invention relates to a portable seat cushion of the type used in automobiles and at sporting events. The portable seat cushion comprises a seat section which detachably rests upon a support surface and which contains in an upper surface thereof a first coolant means. The first coolant means comprises a container having a liquid therein for being frozen and then removably coupled within the seat cushion. A thermally transparent pad is coupled over the coolant means for spacing the occupant from any condensation forming on the coolant means. A back section formed in a substantially identical manner, is foldably coupled to the seat section for cooling the back surface of the occupant. The back section and seat section fold upon each other to provide an insulating container for the coolant means therein.

BRIEF DESCRIPTION OF THE DRAWINGS

Other objects, features and advantages of the present invention will become apparent from a study of the written description and the drawings in which.

DETAILED DESCRIPTION OF THE PREFERRED EMBODIMENT

Figure 1:
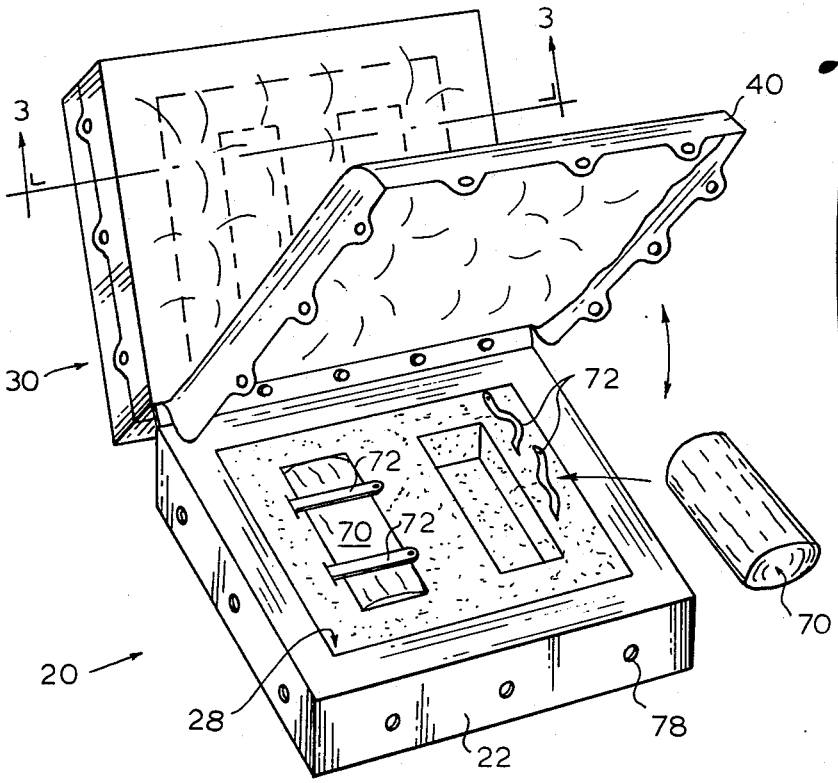
FIG. 1 illustrates a frontal perspective view of a first preferred embodiment of the self-cooling seat in accordance with the present invention.
Figure 3:
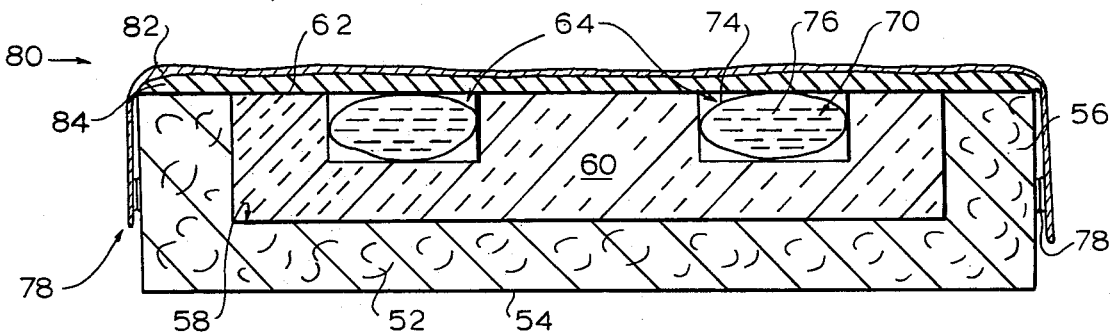
FIG. 3 is a cross-sectioned view taken along section lines 3—3 as shown in FIG. 1.

A first preferred embodiment in accordance with the present invention is illustrated generally as 10 in FIG. 1. The cooling seat 10 comprises a seat section 20 having a back section 50 foldably coupled thereto. While the back section 50 and the seat section 20 have generally the same construction, both will be described with reference to the back section 50 as illustrated by the cross-sectional view shown in FIG. 3.

The back section 50 includes a base 52 which is formed from a foam rubber type substance and has along the outer surface thereof a polyresinous or polyvinyl type covering 54. The base 52 includes upstanding sides 56 about the circumference thereof for defining therein an open void 58 having the form of a rectangular cavity 58.

An insulating insert 60, formed from a styrofoam or other insulating type substance, is dimensioned to collaterally fit within the open void 58 defined by the base 52 and sides 56. A first surface 62 (or upper surface 32 of the seat section 20) has an elevation so as to be generally flush mounted with respect to the upstanding sides 56 of the base 52. The first surface 62 includes therein two recessed cavitites 64 spaced generally symetrically within the insulating insert 60. The recessed cavities 64 each have a generally rectangular shape for receiving therein a coolant 70 which is restrained by the plurality of straps 72. The coolant bags 70 include a bag-type container 74 having therein a liquid 76 for being frozen. In a first preferred embodiment of the present invention the liquid 76 within the coolant 70 is either water or a water and ethylglycol mixture. The liquid 76 is chosen to have a freezing point between 32 degrees Fahrenheit and approximately minus ten (10) degrees Fahrenheit so that the coolant bag 70 may be placed within the freezer compartment of an ordinary household refrigerator for being frozen after a reasonable period of time. The coolant bags 70 may then be removed from the freezer compartment and placed within the recessed cavities 64 of the insulating insert 60 for absorbing heat from an area adjacent the first surface 62 (or upper surface 32) thereof. While two coolant bags 70 are illustrated as being placed within two recessed cavities 64, it is considered to be within the scope and spirit of this invention to employ a single coolant bag or a plurality of coolant bags depending on the specific requirements of the design. Of course, the shape of the bag type container 74 and the mating recessed cavity 64 may be chosen as required. As used herein the term liquid generally means either a flowing or gelatinous substance which when changing from the solid to the liquid state absorbs an additional quantity of heat, commonly known as the heat of crystalization. Other forms of coolant bags 70 which are suitable for use in the cooling seat 10 include those disclosed by Shepherd in U.S. Pat. Nos. 2,800,454; 2,800,455; and, 2,803,115.

A thermally transparent pad, shown generally as 80, is coupled by a plurality of snaps 78 about the periphery of the upstanding sides 56. The pad 80 includes a perforated or foraminous cover 82 which may be formed of a loosely woven fabric or polyresinous or polyvinyl substance having a plurality of perforations therein. The perforated cover 82 is spaced from the first surface 62 of the insulating insert 60 and the coolant bag 70 by a ventilated spacer element 84 which may be formed from any commercially available plastic, rubber or other similar substance. Both the perforated cover 82 and the ventilated spacer 84 have a plurality of holes or spaces therethrough for providing good thermal conductivity of external heat through the pad 80 and into the coolant bags 70. Therefore, any commonly available spacer 84 may be chosen, such as coiled springs, several layers of a loosely woven fiberous material, etc.

The seat section 20 is constructed in a similar manner with the back section 50 as previously explained. The seat section 20 includes a base section 22 having generally upstanding sides 26 communicating circumferentially therearound for defining therein an open void 28. The open void includes therein an insulating insert 30 having an upper surface 32 which is generally parallel with the tops of the upstanding sides 56. A plurality of coolant bags 70 are located within paired ones of a plurality of recessed cavities 34 located within the upper surface 32 of the insulating insert 30. Likewise, a thermally transparent pad 40 is removably attached to the upstanding sides 26 of the base of the seat section 20 by a plurality of snap type fasteners 78.

The lower edge of the back section 50 and the rear edge of the seat section 20 each include flaps, 51 and 21 respectively, having a plurality of snap type fasteners 90 coupled thereto. The snap type fasteners allow the back section 50 to unfold into a seat having a right angle at the lower rear section thereof for providing cooling to the seat as well as the back section. These snap type fasteners 90 may be uncoupled so that the back section 50 may serve as a second seat section for another person.

The upstanding sides 56 of the back section 50 and the upstanding sides 26 of the seat section 20 are colaterally formed so that when the back section 50 is folded about the lips 51 and 21 onto the seat section 20, the insulating insert 60 in the back section 50 communicates closely with the insulating insert 30 within the seat section 20. In this manner, an insulated enclosure is formed by the bases 22 and 52 and the sides 26 and 56 for reducing the ambient heat absorption of the coolant bags 70. The thermally transparent pads 80 which communicate therebetween do allow some heat to be lost but generally this heat loss is only a second order effect.

The ventilated spacer 84 may also include therein a moisture absorbing material for collecting any condensation moisture which may form upon the coolant bags 70 as the solid therein changes into the liquid state.

Figure 2:
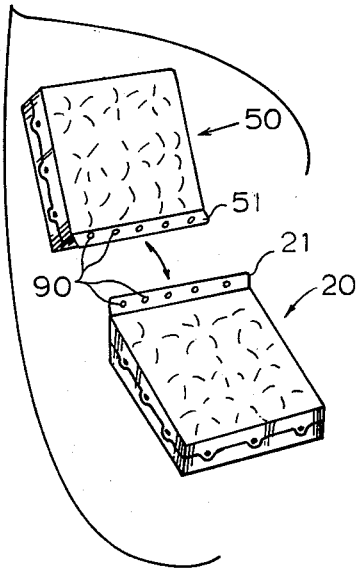
FIG. 2 illustrates the unfolding and separating functions of the cooling seat.

The operation of the self-cooling seat 10 will now be illustrated with reference to FIGS. 1 and 2. First, the coolant bags 70 are removed from both the back section 50 and the seat section 20 of the self-cooling seat 10 and are placed into the freezer section of a refrigerator. After the time required for the liquid 76 therein to freeze, the coolant bags 70 may be removed and placed within the corresponding recessed cavities 34 and 64 in the seat section 20 and back section 50. The thermally transparent pad 80 is then stretched over the coolant bags 70 and secured by means of the snaps 78, or other similar fasteners such as zippers, etc. The back section 50 is then folded into a closed position in close communication with the seat section 20. A master strap or zipper may also be provided about the circumference of the back section 50 and the seat section 20 for securing those two elements together. When the occupant desires to utilize the self-cooling seat 10, he merely unfastens the coupling between the back section 50 and the seat section 20 and places the self-cooling seat 10 onto a horizontal type support. If a back rest is available, the back section 50 may be opened to communicate with it thereby allowing the occupant to sit on the seat section 20. If no back support is available, the back section 50 may be horizontally unfolded or completely uncoupled from the seat section 20 to provide another seat section for a second occupant.

Thus, a first preferred embodiment of a self-cooling seat has been illustrated as an example of the invention as claimed. However, the present invention should not be limited in its application to the details illustrated in the accompanying drawings and the specification since this invention may be practiced and constructed in a variety of different embodiments. Also, it must be understood that the terminology and description employed herein are used solely for the purpose of describing the general operation of the perferred embodiment and therefore should not be construed as limitations on the operability of the invention.

I claim:

1. A portable seat cushion comprising in combination:

a seat section for detachably resting on a supporting surface, said seat section defined by a first base section having generally upstanding circumferential sides for forming an opening central void therein;

said seat section further including a first insert formed of an insulating material for removably coupling within said central void, said insert further including an open recessed cavity therein;

first coolant means comprising a container having a liquid therein for being frozen and then removably coupled within said recessed cavity for absorbing heat from adjacent said central void of said seat cushion;

first pad means coupled over said coolant means and said central void of said seat cushion for transferring heat therethrough, said first pad means including a foraminous cover and a ventilated spacer means for spacing said foraminous cover from said first coolant means, whereby moisture forming on said first coolant means will not be exposed to the occupant of said cushion, and such that said seat section and the occupant are cooled by the transfer of heat through said first pad means into said first coolant means.

2. The portable seat cushion as described in claim 1 further comprising:

a back section, defined by a second base section having generally upstanding circumferential sides for forming an open central void therein, said back section movably coupled to said seat section for allowing said back section to fold from a seating position over said seat section for storage;

said back section further including a second insert formed of an insulating material for removably coupling within said central void of said second base section, said insert further including an open recessed cavity therein;

second coolant means comprising another container having said liquid therein for being frozen and then removably coupled within said recessed cavity of said second insert for absorbing heat from adjacent said central void of said back section; and second pad means coupled over said second cooling means and said back section for transferring heat therethrough, said second pad means including another foraminous cover and ventilated spacer means combination, whereby moisture forming on said second coolant means will not be exposed to the occupant of said cushion, and whereby said back section and the occupant thereof are cooled by the transfer of heat through said second pad means to said second coolant means.

3. The portable seat cushion as described in claim 2 wherein said containers of said first and second coolant means comprise a flexible sealed bag and wherein said liquid freezes at a temperature in the range of zero degrees Fahrenheit to 32° Fahrenheit.

4. A portable seat cushion as described in claim 3 wherein said liquid is water.

5. The portable seat cushion as described in claim 3 wherein said liquid is a mixture of water and ethyl glycol.

6. The portable seat cushion as described in claim 3 wherein said first and second base sections are formed from a foam rubber material and wherein said first and second inserts are formed from a styrofoam material.

7. The portable seat cushion as described in claim 3 wherein said upstanding sides of said seat section and said back section are generally aligned for enclosing said open central voids therein as said seat and back sections are foldably coupled upon each other, thereby forming a substantially closed compartment for insulating said first and second coolant means enclosed therein.

8. The portable seat cushion as described in claim 7 wherein said seat section and said back section are detachably coupled for forming two independent seat cushions.

9. The portable seat cushion as described in claim 7 wherein said ventilated spacer means is formed from a perforated polyresinous material and wherein said foraminous covers is formed from a coarsely woven fabric.

* * * * *